US006554656B2

(12) United States Patent
Hatagishi et al.

(10) Patent No.: US 6,554,656 B2
(45) Date of Patent: Apr. 29, 2003

(54) METHOD AND STRUCTURE FOR ASSEMBLING RESIN PARTS

(75) Inventors: Yuji Hatagishi, Shizuoka (JP); Kentaro Nagai, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/946,502

(22) Filed: Sep. 6, 2001

(65) Prior Publication Data

US 2002/0028611 A1 Mar. 7, 2002

(30) Foreign Application Priority Data

Sep. 7, 2000 (JP) ..... 2000-272036

(51) Int. Cl.[7] ..... H01R 13/514
(52) U.S. Cl. ..... 439/752; 264/297.2
(58) Field of Search ..... 29/757, 762, 426.6; 264/297.2, 297.8; 439/752

(56) References Cited

U.S. PATENT DOCUMENTS 3,013,308 A * 12/1961 Armour ..... 220/291
4,159,770 A * 7/1979 Beyerle ..... 206/577
5,595,341 A * 1/1997 Robinson et al. ..... 232/17

FOREIGN PATENT DOCUMENTS

JP 9-219236 8/1997 ..... H01R/13/42

* cited by examiner

*Primary Examiner*—Lynn D. Feild
*Assistant Examiner*—Phuong Dinh
(74) *Attorney, Agent, or Firm*—Sughrue Mion, PLLC

(57) ABSTRACT

A primary compact is formed as a resin article by using a single die to thereby integrally mold a connector housing, a rear holder, and a lock spacer so that the attaching directions of such parts are the same direction. In an assembling process, the connector housing is detached from the primary compact. Subsequently, the rear holder adjoining the connector housing is detached from a sub-runner. Then, a terminal slipping-off preventing piece of the rear holder is inserted into a terminal insertion opening of the connector housing from above the terminal insertion opening. Thereafter, the lock spacer adjoining the rear holder is detached from the sub-runner and inserted into a latching concave portion of the connector housing from above in such a manner as to be in a temporarily caught state. Thus, the parts are assembled into a connector.

7 Claims, 5 Drawing Sheets

METHOD AND STRUCTURE FOR ASSEMBLING RESIN PARTS

CROSS REFERENCE TO THE RELATED APPLICATION

The present application is based on Japanese Patent Application No. 2000-272036, which is incorporated herein by reference.

BACKGROUND OF THE INVENTION

1. Field of the Invention

The present invention generally relates to assembly of resin parts, more particularly, to a method for assembling resin parts into a product by serially detaching resin parts from a primary compact, which is an aggregate of the resin parts, one of which serves as a base part, and subsequently attaching the detached resin parts, which are other than the base part, to the base part.

2. Description of the Related Art

In the case of a conventional assembly structure having a plurality of resin parts, which are serially attached to a resin part serving as a base part, each of the resin parts is resin-molded by using a corresponding die. Further, the molded resin parts are stocked after taken out of the dies. At that time, the resin parts individually packed and undergo a part management operation. Thereafter, when the resin parts are transported to an automatic assembly system, each of the resin parts is supplied to a part feeder for supplying parts thereto. Then, a product is produced by serially attaching the parts, which is other than the base part, to the base part.

FIG. 8 illustrates such a conventional assembly structure disclosed in JP-A-9-219236.

A connector housing 100 and a retainer 200 are resin parts, each of which is resin-molded by using a corresponding die. Each of the molded connector housing 100 and the molded retainer 200 is then packed and transported to an automatic assembly system. In the automatic assembly system, each of the connector housing 100 and the retainer 200 is supplied to a corresponding part feeder. Then, the retainer 200 is attached to the connector housing 100 from an opening portion provided in the bottom surface portion thereof in such a manner as to be in a temporarily caught state. Subsequently, a terminal 300 is inserted into the connector housing 100 from a terminal insertion opening. Thereafter, the retainer 200 having been temporarily caught in the connector housing 100 is fully caught therein, so that the terminal 300 is locked in the connector housing 100 in such a way as to be prevented from slipping off therefrom.

However, in the aforementioned conventional assembly structure having the resin parts, such resin parts are formed by using different dies, respectively. Thus, this conventional assembly structure cannot prevent the manufacturing cost of the connector from steeply rising with an increase in the number of dies to be used. Moreover, every time when the molded resin parts are transported or assembled, the part management operation should be performed on each of the resin parts. This increases the number of man-hours needed for performing the part management operations. Furthermore, although an assembling operation using an automatic assembly machine is performed in the automatic assembly system by utilizing part feeders so as to enhance working efficiency, an increase in the number of resin parts results in an increase in the number of part feeders. Consequently, the size and complexity of the automatic assembly machine are inevitably increased.

SUMMARY OF THE INVENTION

The invention is accomplished in view of the aforementioned circumstances. Accordingly, an object of the invention is to provide a method for assembling a plurality of resin parts, which integrally forms the plurality of resin parts thereby to reduce the number of man-hours needed for performing the part management operations, and which performs the layout of the integrally-molded resin parts of a primary compact in such a manner as to be effective in efficiently assembling the resin parts into a product in a subsequent assembling process.

To achieve the foregoing object, according to the invention, there is provided a method (hereunder referred to as a first assembling method) for assembling resin parts, which comprises the steps of transporting a primary compact, which is constituted by a plurality of resin parts integrally formed so that attaching directions of the plurality of resin parts are the same one, to an assembly system, and of detaching the plurality of resin parts, one of which serves as a base part, from the primary compact according to an assembling procedure and thereafter attaching the resin parts, which is other than the base part, to the base part.

Thus, the resin parts are integrally formed so that the attaching directions of the plurality of resin parts are the same with one another. Consequently, the resin parts other than the base part are serially moved to the base part by being maintained in a state in which the resin parts are detached from the primary compact. Moreover, the resin parts other than the base part are easily attached to the base part.

Further, according to another aspect of the present invention (hereunder referred to as a second assembling method), the primary compact may include different kinds of resin parts.

According to the second assembling method of the invention, the primary compact is constituted in this manner, so that the resin parts other than the base part are serially attached to the base part according to the assembling procedure by detaching each of the resin parts from the primary compact when needed in the assembling process. This eliminates the necessity for the part feeders that are needed in the conventional assembling method. Consequently, the configuration of the assembly system is simplified. Moreover, the part management operation to be performed on the resin parts is facilitated.

Moreover, according to another aspect of the present invention (hereunder referred to as a third assembling method), the plurality of resin parts of the primary compact are of the same kind of resin. That is, the assembling method may be adapted so that primary compacts, each of which consists of a plurality of parts of the same kind, are formed in such a manner as to correspond to different kinds of parts, respectively, that subsequently, such a plurality of kinds of primary compacts are transported to the automatic assembly system, and that when assembling the resin parts into a product, the resin parts are serially detached from the corresponding primary compacts, respectively, and then assembled into the product.

According to the third assembling method of the invention, the primary compact is constituted in the above manner, the resin parts are collectively and intensively managed. Consequently, the part management operation to be performed on the resin parts is facilitated. Moreover, the transportation of the resin parts to the assembly system, in which the subsequent assembly process is performed, is facilitated.

DETAILED DESCRIPTION OF THE PREFERRED EMBODIMENT

Hereinafter, a preferred embodiment of a method for assembling resin parts into a product according to the invention is described with reference to the accompanying drawings.

Figure 1:
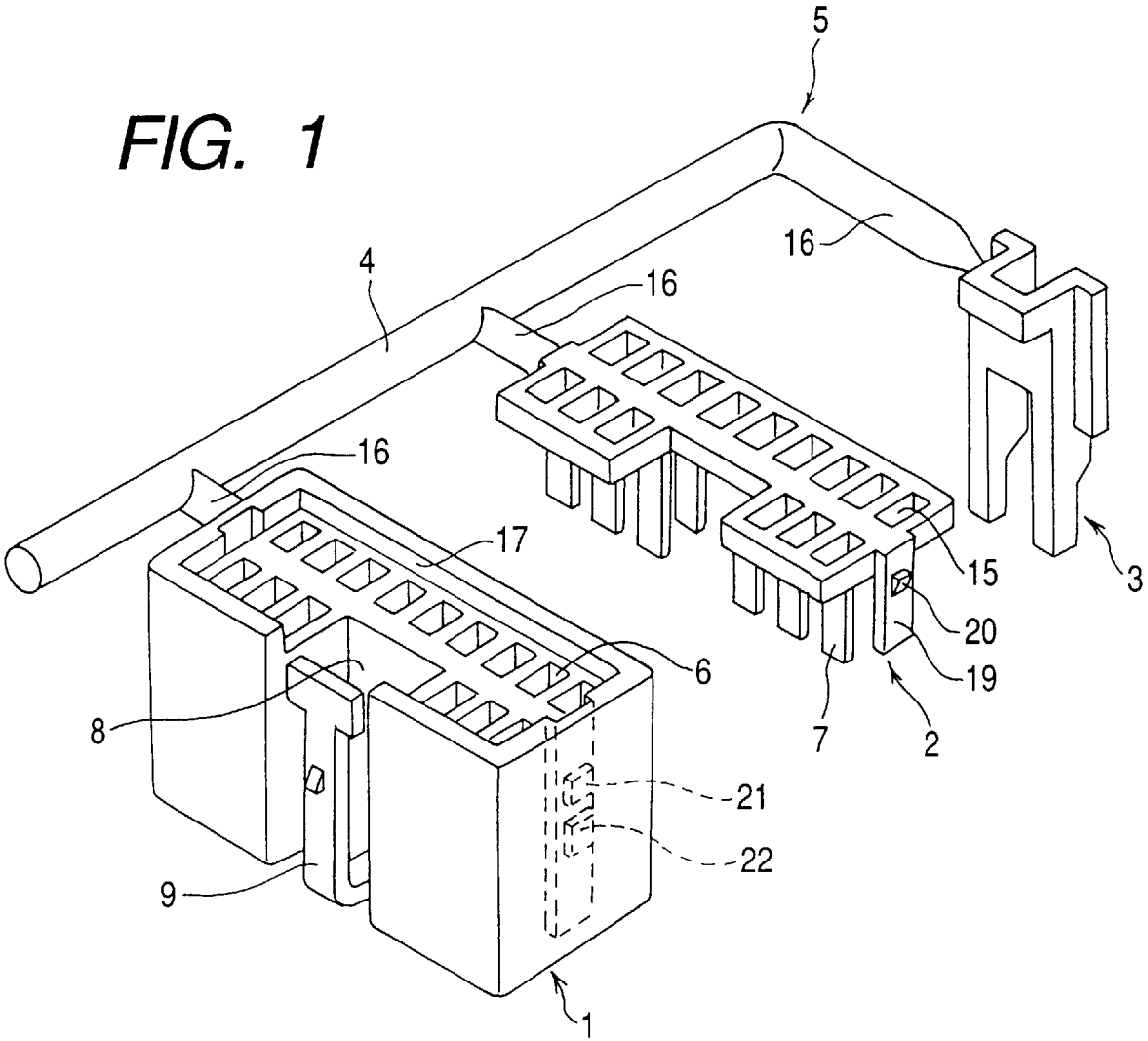
FIG. 1 is a perspective view illustrating a primary compact used in an embodiment of the invention, according to which resin parts are assembled into a product.

FIG. 1 is a perspective view illustrating a part of a primary compact used in the method for assembling resin parts into a product according to the invention. Incidentally, in the following description of this embodiment, the assembling method for assembling resin parts into a product according to the invention is applied to the case of assembling a connector.

According to this embodiment, as illustrated in FIG. 1, the assembling method of the invention is performed by using a primary compact 5, which is formed by integrally molding a plurality of kinds of resin parts in a single die.

That is, the primary compact 5 is formed by integrally molding a connector housing 1 serving as a base part, a rear holder 2, which is attached to this connector housing 1 and performs double locking of a terminal, and a lock spacer 3 that is engaged with a lock arm 9 of the connector housing 1 and restricts the movement of the lock arm 9.

More particularly, the primary compact 5 is held by a main runner 4, which is formed when the connector housing 1, the rear holder 2, and the lock spacer 3 are injection-molded, and a sub-runner 16 connected to this main runner 4. Further, each of gate portions connecting a corresponding one of the resin parts 1, 2, and 3 to the sub-runner 16 is connected therebetween at proper strength so that the resin parts 1, 2, and 3 are not accidentally detached from the sub-runner 16 before the subsequent assembly process, and that conversely, the resin parts 1, 2, and 3 are easily detached from the sub-runner 16 in the subsequent assembly process.

This embodiment features the layout of the resin parts 1, 2 and 3 of the primary compact 5, which is set for easiness of assembling performed in the subsequent automatic assembly process so that the attaching directions of the resin parts are the same direction and that the resin parts are serially detached from the primary compact 5 from one of the sides thereof.

That is, in the automatic assembly process, the connector housing 1 serving as the base part is detached from the primary compact 5. Subsequently, the rear holder 2 adjoining the connector housing 1 is detached from the sub-runner 16. Then, the terminal slipping-off piece 7 of the rear holder 2 is inserted into the terminal insertion opening 6 of the connector housing 1, which is directed upwardly, as viewed in this figure, from above. Thereafter, the lock spacer 3 adjoining the rear holder 2 is detached from the sub-runner 16 and inserted into the catching concave portion 8 of the connector housing 1 in such a way as to be in a temporarily caught state. Thus, the resin parts are assembled into a connector. Incidentally, before the rear holder 2 is attached thereto, a terminal (not shown) transported through an alternate system is inserted into the connector housing 1 from the terminal insertion opening 6 thereof.

Because the primary compact 5 is constituted as described above, the configuration of an automatic assembly machine is simplified by, for instance, minimizing the movement of an arm adapted to chuck the parts when the resin parts are serially detached from the primary compact 5, or when the detached resin parts 2 and 3 are sequentially attached to the resin part 1 serving as the base part.

Further, from the viewpoint of the part management, the primary compact 5 is collectively managed because the connector housing 1, the rear holder 2, and the lock spacer 3 are held by the main runner 4 and the sub-runner 16. Thus, the parts are collectively managed, so that the management cost thereof is reduced.

Next, a process from the formation of the primary compact to the attachment of the resin parts, which is other than the base part, to the base part is described hereinbelow with reference to FIGS. 2 to 7.

Figure 2:
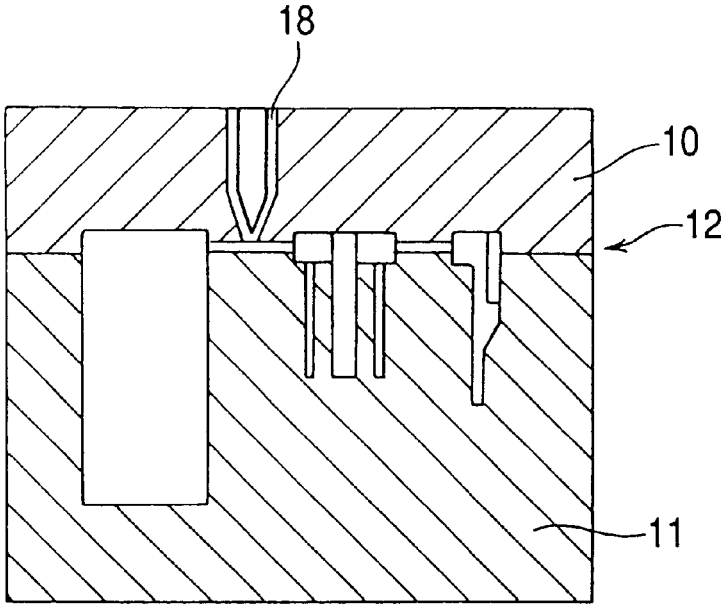
FIG. 2 is a sectional view illustrating a die for resin-molding the primary compact of FIG. 1.

FIG. 2 illustrates a step of integrally forming the primary compact 5 by using a die.

The die 12 consisting of an upper die 10 and a lower die 11 is first set. Then, molten resin is injected into the die 12 from an inlet 18 thereof, so that the primary compact 5 is resin-molded. After the molten resin is cooled, the upper die 10 and the lower die 11 are opened, so that the primary compact 5 is taken out therefrom. Incidentally, thereafter, the upper die 10 and the lower die 11 are set again so as to form the next primary compact 5.

Figure 3:
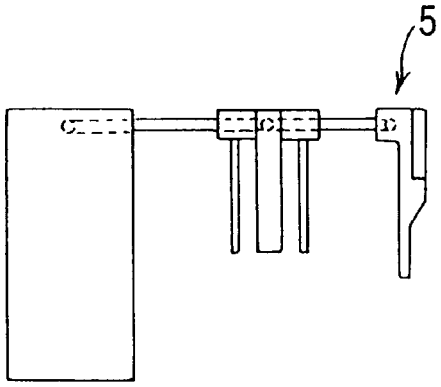
FIG. 3 is a plan view illustrating a primary compact drawn out of the die.

FIG. 3 illustrates the primary compact 5 taken out of the die 12.

The primary compacts 5 taken out of the die 12 are serially stocked. Then, the primary compacts 5 are inspected for defects and collectively managed. Thereafter, the primary compacts 5 are transported to an automatic assembly system. In the case of continuously performing the process from the formation of the primary compacts 5 to the assembly of the connector, the primary compacts 5 are transported to the automatic assembly system just after taken out of the die 12.

Figure 4:
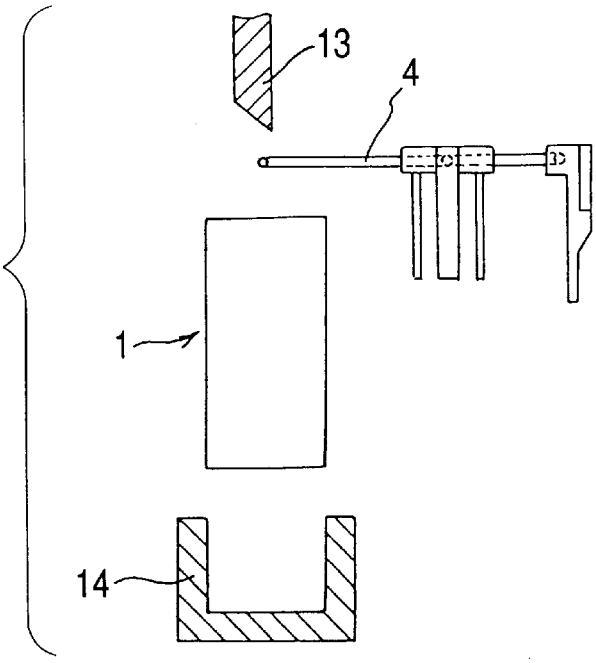
FIG. 4 is a view illustrating a resin-part assembling process and also illustrating a manner of detaching a connector housing from a primary compact.

FIG. 4 illustrates the connector housing 1 detached from the primary compact 5.

When the primary compact 5 is transported to a predetermined place in the automatic assembly system through a transportation line by maintaining the primary compact 5 in a state in which the main runner 4 is fixed therein, first, the connector housing 1 serving as the base part is detached from the primary compact 5.

In such a case, although the resin parts are respectively supplied to the corresponding part feeders in the conventional system, this embodiment does not need the part feeders because the collective management of the resin parts is performed by utilizing the primary compact 5. Consequently, the configuration of the automatic assembly machine is simplified.

The connector housing 1 is detached at the gate portion, which has been operative to connect the sub-runner 16 to the connector housing 1, by lowering a cutting tool 13, such as a cutter, placed above the primary compact 5 during the primary compact 5 is held by a chuck mechanism (not shown). The detached connector housing 1 is placed on a transportation device 14 disposed under the primary compact 5.

The connector housing 1 disposed on the transportation device 14 is held in the primary compact 5 so that the attaching direction of the rear holder 2 to be attached to the connector housing 1 is the same as the attaching direction of the connector housing 1. Thus, the transportation device 14 is moved to a place just under the rear holder 2. That is, the connector housing 1 is placed immediately under the rear holder 2. This facilitates the attachment of the rear holder 2, which is detached from the sub-runner 16, to the base part.

Figure 5:
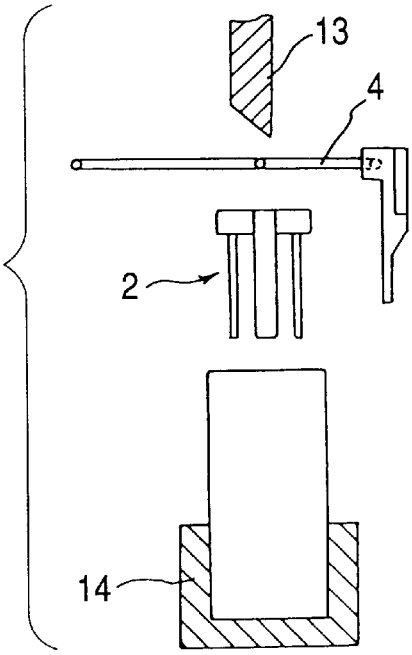
FIG. 5 is a view illustrating a resin-part assembling process and also illustrating a manner of detaching a rear holder from a primary compact and of attaching the rear holder to the connector housing.

FIG. 5 illustrates the manner of attaching the rear holder 2 to the connector housing 1.

When the cutting tool 13 disposed above the rear holder 2 falls and the rear holder 2 is detached from the sub-runner 16, the rear holder 2 goes down while the holder 2 remains held by the chuck mechanism. Then, the rear holder 2 is attached to the connector housing 1 placed on the transportation device 14 in such a way as to be in a state in which a temporarily caught state. That is, the terminal slipping-off preventing piece 7 of the rear holder 2 is inserted into the terminal insertion opening of the connector housing 1. Then, a catching protrusion 20 formed on a catching piece 19 in such a manner as to protrude therefrom is caught in a temporarily catching hole 21 formed in a corresponding inner wall surface portion of the connector housing 1. Thereafter, when a terminal (not shown) penetrates through a terminal insertion opening 15 of the rear holder 2 and the terminal insertion opening 6 of the connector housing 1 and is then accommodated in the connector housing 1, the rear holder 2 is pushed into a concave portion 17 at the rear end of the connector housing 1, and fully caught therein by moving the catching projection 20 into a fully catching hole 22 of the connector housing 1.

When the rear holder 2 is attached to the connector housing 1, this housing 1 is moved by the transportation device 14 to a place just under the lock spacer 3 held in the primary compact 5.

Figure 6:
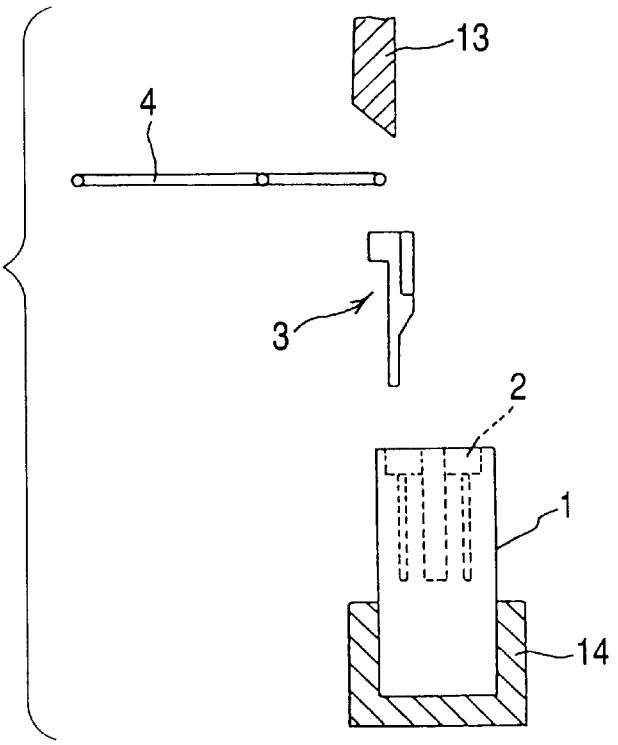
FIG. 6 is a view illustrating a resin-part assembling process and also illustrating a manner of detaching a lock spacer from a primary compact and of attaching the lock spacer to the connector housing.

FIG. 6 illustrates the manner of attaching the lock spacer 3 to the connector housing 1.

When the cutting tool 13 placed above the lock spacer 3 falls and thus the lock spacer 3 is detached from the sub-runner 16, the lock spacer 3 goes down while the lock spacer 3 remains held by the chuck mechanism. Then, the lock spacer 3 is attached to the concave portion 8 of the connector housing 1 placed on the transportation device 14 in such a way as to be in a state in which a temporarily caught state. Even in this case, the lock spacer 3 is held in the primary compact 5 so that the attaching direction of the lock spacer 3 is the same as those of the connector housing 1 and the rear holder 2. Thus, the lock spacer 3 is caused to go down from a place at which the lock spacer 3 is detached from the primary compact 5. Consequently, the lock spacer 3 is easily attached to the connector housing 1 and the rear holder 2.

Figure 7:
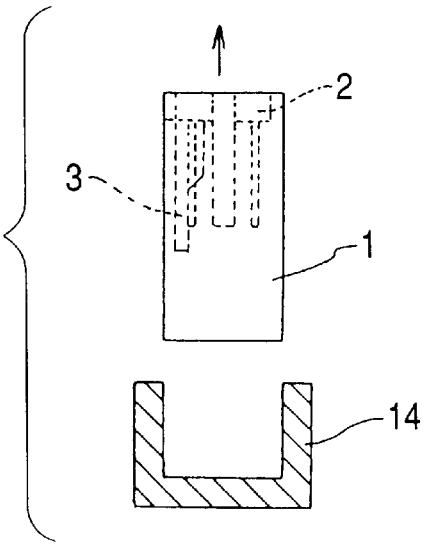
FIG. 7 is view illustrating a manner of taking an assembled connector out of a transportation device.
Figure 8:
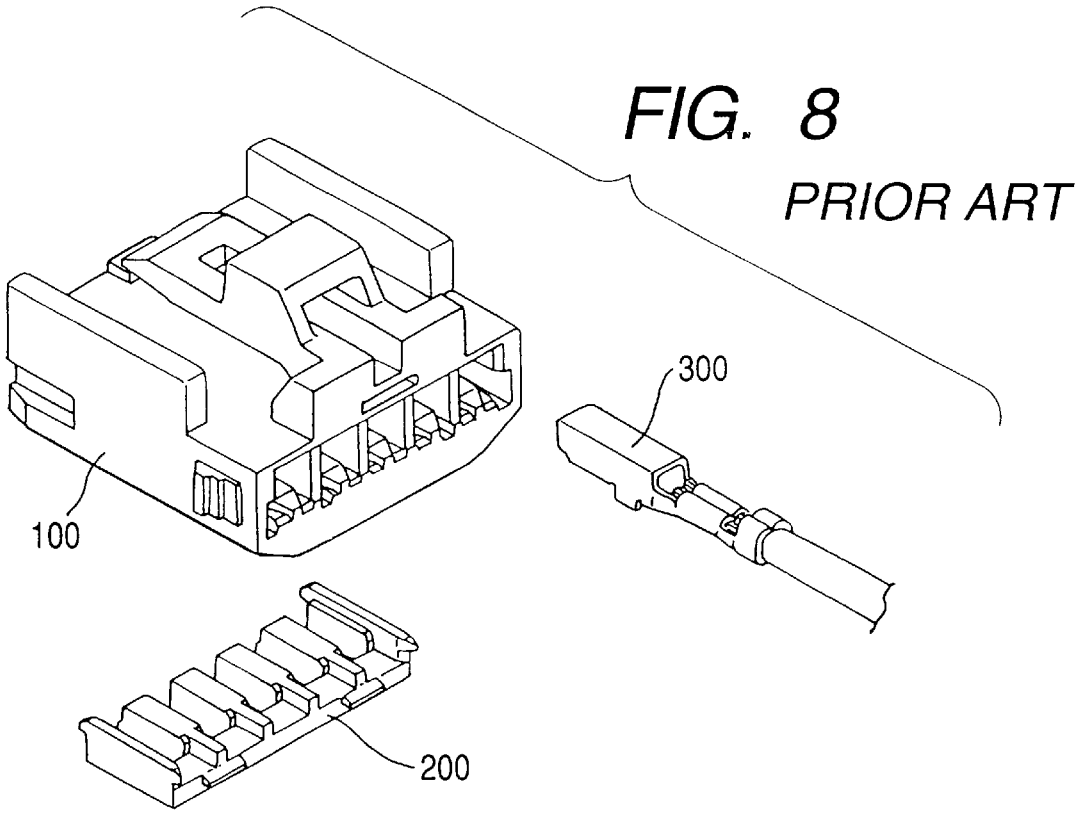
FIG. 8 PRIOR ART
FIG. 8 is an exploded perspective view illustrating a conventional assembly structure of a resin part.

FIG. 7 illustrates the manner of taking the connector out of the transportation device when the assembly of the connector is completed.

That is, the connector fabricated by serially attaching the rear holder 2 and the lock spacer 3 to the connector housing 1 disposed on the transportation device 14 is taken out therefrom and stocked in a stocker for accommodating connectors. On the other hand, the main runner 4 and the sub-runner 16, which are the remaining portions of the primary compact 5, are transported to a remainder processing portion (not shown) and cut out therein so as to be recycled.

Then, the transportation device 14, the chuck mechanism, the cutting tool 13 of the automatic assembly machine are returned to initial positions thereof so as to detach a connector housing 1 from the next primary compact 5. Further, the machine repeats the aforementioned process until the assembly of all connectors is completed.

Although the assembly system is adapted according to the aforementioned embodiment so that the primary compact 5 is fixed on the assembly line and that the resin parts 1, 2, and 3 are serially detached from the primary compact 5 and then attached to the connector housing 1 serving as the base part placed on the transportation device 14 that has been moved just under the resin parts, various modifications may be made without departing from the spirit and scope of the invention.

For example, the assembling method may be adapted so that the connector housing 1 serving as the base part detached from the primary compact 5 is preliminarily fixed onto an assembly platform, that the primary compact 5 supporting the main runner 4 by the arm is then transported just above the connector housing 1 fixed onto the assembly platform, and that subsequently, the rear holder 2 and the lock spacer 3 are serially detached from the primary compact 5 and then attached to the connector housing 1.

Further, according to the aforementioned embodiment, the different kinds of resin parts are integrally formed as the primary compact 5. However, the assembling method may be adapted so that primary compacts, each of which consists of a plurality of parts of the same kind, are formed in such a manner as to correspond to different kinds of parts, respectively, that subsequently, such a plurality of kinds of primary compacts are transported to the automatic assembly system, and that when assembling the resin parts into a product, the resin parts are serially detached from the corresponding primary compacts, respectively, and then assembled into the product. Moreover, in the system for assembling the resin parts of the compact, the automatic assembly machine may be configured in such a manner as to perform an automatic assembling process for attaching components manufactured in other processes, for example, metallic components, such as metal fittings and circuits to be attached to the resin parts, and conductive components.

Additionally, the method for assembling resin parts according to the invention is applied not only to the connector, which has been described in the foregoing description thereof, but to all products formed by assembling resin parts thereto, for instance, interior light fittings, curtain lamps, and a switching device for use in vehicles.

As described above, according to the method for assembling resin parts according to the invention, a primary compact, which is constituted by a plurality of resin parts integrally formed so that attaching directions of the plurality of resin parts are the same one, is transported to an assembly system. Subsequently, the plurality of resin parts, one of which serves as a base part, are detached from the primary compact according to an assembling procedure. Thereafter, the resin parts other than the base part are attached to the base part. Thus, the configuration of the automatic assembly machine is simplified. Moreover, the number of man-hours needed for performing the part management operations when the compact is transported to the assembly system, is reduced. Furthermore, the collective management of the resin parts put together as the compact is enabled. This reduces the manufacturing cost of products. Moreover, this eliminates the necessity for the part feeders that are needed in the conventional assembling method. Consequently, the size of the assembly system is reduced. Furthermore, in the case of integrally forming a plurality of parts of different kinds by using a single die, the management cost is reduced still more owing to a reduction in the number of dies to be used.

What is claimed is:

1. A method for assembling resin parts comprising the steps of:

injection molding a primary compact having a runner and a plurality of said resin parts fixed to said runner, said resin parts including a base part and at least one additional part, wherein, during injection molding, a molding material flows in only one direction as said molding material passes (1) from a die portion forming said runner and (2) into die portions respectively forming all of said resin parts;

transporting said primary compact to an assembly system;

detaching said base part from said runner of said primary compact;

detaching said additional part from said runner of said primary compact; and attaching said additional part to said base part.

2. A method for assembling resin parts according to claim 1, wherein said resin parts are of different kinds.

3. A method for assembling resin parts according to claim 1, wherein said base part is placed on a transportation device and moved to a position substantially under said additional part, so that said additional part is attached to said base part.

4. A method for assembling resin parts comprising the steps of:

injection molding a primary compact having a runner and a plurality of said resin parts, said resin parts including a base part and at least two additional parts;

transporting said primary compact to an assembly system;

detaching said base part from said runner of said primary compact and placing said base part on a transportation device;

detaching said additional parts from said runner of said primary compact; and attaching said additional parts to said base part;

wherein attaching directions of said at least two additional resin parts to said base part coincide with each other.

5. A method as define in claim 4, wherein said base part and said additional parts are disposed in line through a main runner.

6. A method as defined in claim 4, wherein said additional parts are attached to said base part in a state that said base part is disposed just under said additional parts.

7. A method as defined in claim 4, wherein said attaching directions coincide with a direction in which said primary compact is detached from a mold.

* * * * *